US005218793A

United States Patent [19]

Ball

[11] Patent Number: 5,218,793

[45] Date of Patent: Jun. 15, 1993

[54] COMBINATION SILL SEALER AND FLASHING

[76] Inventor: Daniel J. Ball, 10129 Bracken Dr., Ellicott City, Md. 21043

[21] Appl. No.: 729,398

[22] Filed: Jul. 12, 1991

[51] Int. Cl.[5] ..... E04D 1/36

[52] U.S. Cl. ..... 52/62; 52/412; 52/169.5

[58] Field of Search ..... 52/58, 101, 305, 408, 52/411, 412, 413, 459, 461, 169.11, 293, 61, 62, 573, 169.5, 96

[56] References Cited

U.S. PATENT DOCUMENTS

| | | | |
|---|---|---|---|
| 2,071,687 | 2/1937 | Friedberg | 52/305 |
| 4,485,600 | 12/1984 | Olson | 52/62 |
| 4,941,300 | 7/1990 | Lysons, Jr. | 52/58 |
| 5,065,553 | 11/1991 | Magid | 52/58 |
| 5,091,235 | 2/1992 | Vergnano . | |

FOREIGN PATENT DOCUMENTS

| | | | |
|---|---|---|---|
| 510612 | 3/1955 | Canada | 52/61 |
| 970582 | 7/1975 | Canada | 52/169.11 |
| 1913928 | 10/1970 | Fed. Rep. of Germany | 52/61 |

*Primary Examiner*—Carl D. Friedman
*Assistant Examiner*—Kien Nguyen
*Attorney, Agent, or Firm*—Sherman and Shalloway

[57] ABSTRACT

A combination sill sealer and flashing for use in wood frame construction to provide sealing and insulation between frame sub structures while accommodating shrinkage and settling of those substructures as the lumber drys. The sill sealer and flashing comprises a sheet of flexible material that is vapor permeable and liquid impermeable along one long edge of which is formed a longitudinally continuous channel in which is disposed a contiguous length of sealant material. The sealant material may be a rope of polymeric foam, a curable silicon, or other synthetic rubber like material which is resiliently compressible and retains its pliancy over time and under a wide range of temperatures.

14 Claims, 4 Drawing Sheets

FIG. 8
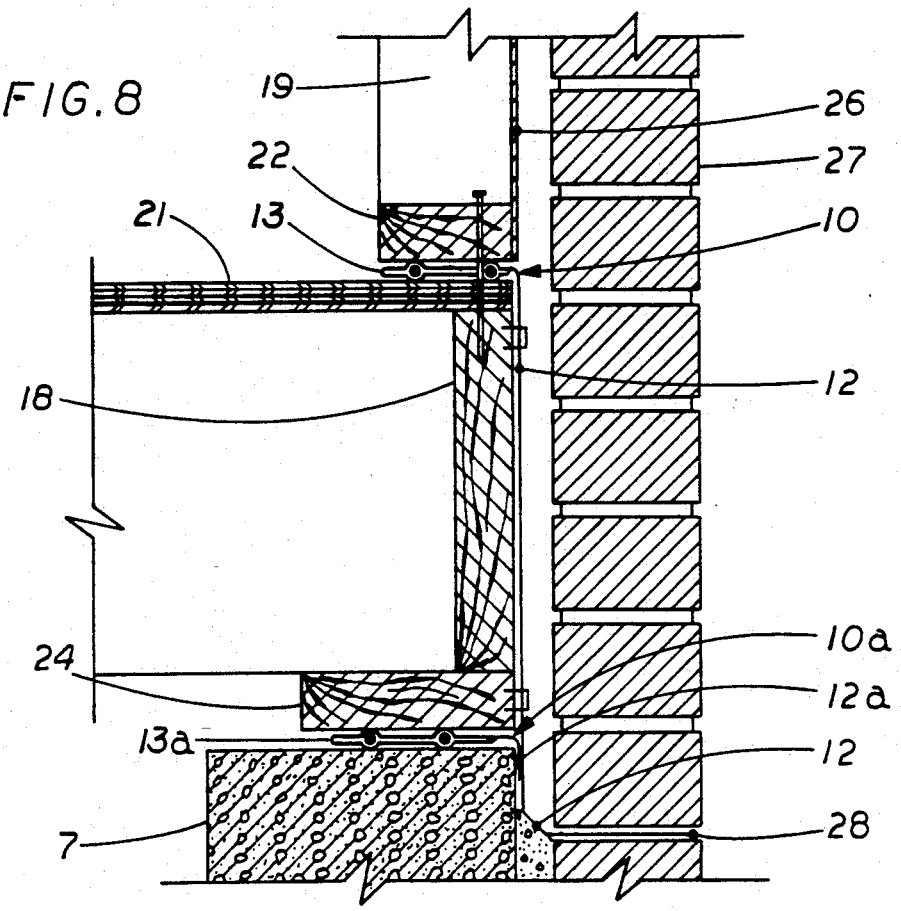
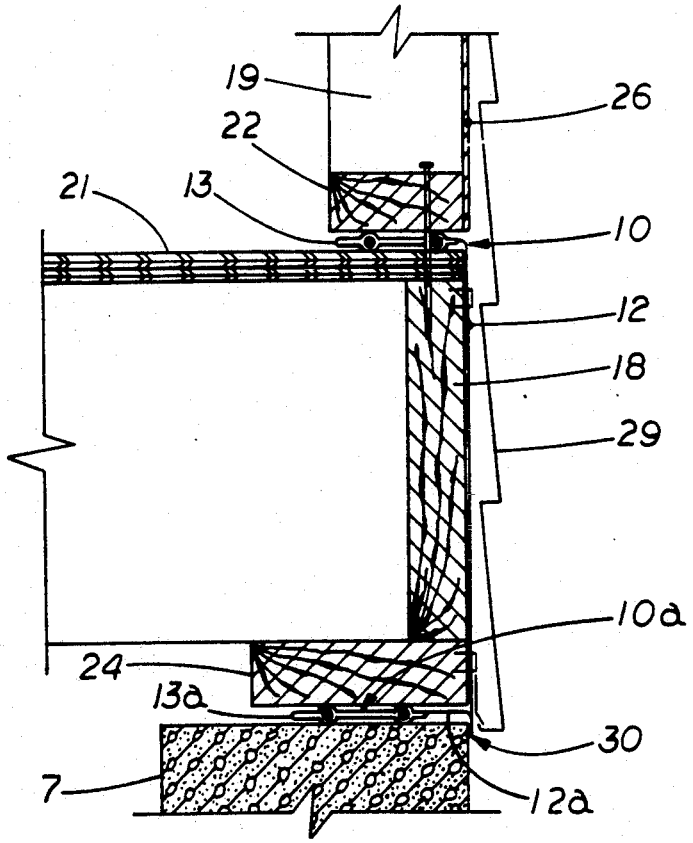
FIG. 9

COMBINATION SILL SEALER AND FLASHING

FIELD OF THE INVENTION

The present invention relates to a combination sill sealer and flashing for use in the construction industry as a cure for buckling problems experienced in house siding and the like as the result of shrinkage of lumber elements used in light wood frame construction. It may also have application in metal framed construction.

BACKGROUND OF THE INVENTION

In standard wood frame house construction, the stud walls of an upper floor are built upon the floor and joists of the lower floor. The joint areas between the stud walls and the floor, as well as the band joist and sill plate of the floor, are usually covered by under sheathing or substantially rigid sheets of thermal insulation. Siding is then applied over the under sheathing to provide a finished outer wall. When the lumber used in the frame construction has a high moisture content it will be subject to drying over time with consequent shrinkage of the wood and separation between individual substructures such as the stud walls and the flooring on which they are built. In addition, the resulting space between the substructures may then collapse or settle resulting in a shorter distance across the joint area. This shrinkage and separation with eventual settling inevitably causes the under sheathing to buckle or separate which, in turn, causes the siding to be pushed out or separated and can result in air and water leakage of the wall and popping off of individual strips of the siding. The herein disclosed invention provides a way to maintain a good seal between the substructures for reduced air and water leakage and to avoid buckling or other damage to the under sheathing and siding.

SUMMARY OF THE INVENTION

The combined sill sealer and flashing of the invention comprises a flexible sheet of material that is vapor permeable but will not pass liquid water. Along one edge, confined by a folded over or double layer portion of the sheet, is a compressible material which is capable of forming an airtight seal between surfaces to be sealed. The folded over or double layer portion containing the compressible material is place between the surfaces to be sealed, such as between a floor and the bottom plate of a stud wall. The seal, whether foam or sealant type, will be compressed between these structures. The rest of the sheet is allowed to hang over the outer side of the edge of the floor joists and, possibly the lower floor wall framing and is held in place by appropriate fasteners such as staples. Where there is a brick, stone or other masonry type facing or veneer erected over the outer face of the stud wall, the end of the sheet remote from the sealant may be extended into and through a coursing of the veneer to provide weep holes and a conductor for condensate and liquid water from between the stud wall and the brick, stone or other masonry veneer. The flexible sheet provides a liquid proof cover over the ends of the frame members that is not rigid but provides sufficient sealing and water proofing such that the normal rigid thermal sheathing is not needed. The flexibility of the sheet allows it to wrinkle and fold as the wood drys out and shrinks rather than buckling outward as the prior rigid sheets do. It is the buckling of the prior undersheathing that causes the separation and popping of exterior siding treatments which it is the intention of this invention to cure.

It is therefor an object of this invention to provide a combination sill sealer and flashing for use in building construction.

It is a further object of this invention to provide a means for preventing buckling of siding caused by shrinkage of wood frame construction and resultant buckling of the undersheathing.

It is a still further object of this invention to provide a combination sill sealer and flashing that can be used with flush face and cantilever construction methods.

And it is an even further object to provide a combination sill sealer and flashing that can be used behind brick, stone or other masonry type facings to channel water and liquid condensation.

Other objects will become evident from the following drawings and descriptions.

BRIEF DESCRIPTION OF THE DRAWINGS

FIG. 8 is a vertical cross section of a flush face first floor construction employing the combination sill sealer and flashing of the present invention behind a brick facing.

FIG. 9 is a vertical cross section of a flush face first floor construction employing the combination sill sealer and flashing of the present invention behind exterior siding.

DETAILED DESCRIPTION OF THE INVENTION

Figure 1:
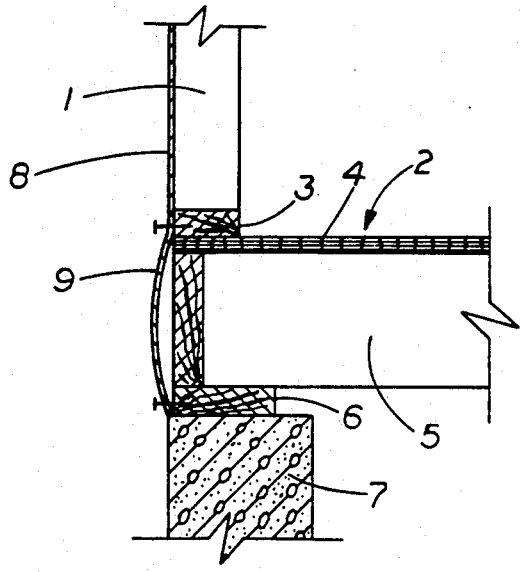
FIG. 1 PRIOR ART
FIG. 1 is a vertical cross section of a building construction showing the problem encountered in the prior art.

FIG. 1 illustrates the problem encountered in the prior art that the present invention seeks to correct. In wood frame construction, the stud walls 1 are built upon the preceding floor 2 with the wall plate 3 resting on the sub flooring 4. Beneath the sub flooring 4 are the main floor joists 5, the sill plate 6 and the foundation 7. Normally, the outer face of the stud wall and the floor joists are covered with sheathing 8 which is usually nailed or stapled in place. The problem occurs when structures of this type are built using lumber of a high moisture content. As such lumber dries out following construction, it shrinks allowing gaps to form between sections and resulting in settling of the entire structure. Since the sheathing applied over the frame is substantially rigid and is commonly nailed across joints in the frame, as this settling occurs, the sheathing will tend to buckle and bow outward 9. The result of this is a weakening of the sheathing and the buckling or popping off of any siding that has been applied over it. In addition, air and water leakage may occur where two sheets of sheathing come together in such areas.

Figure 2:
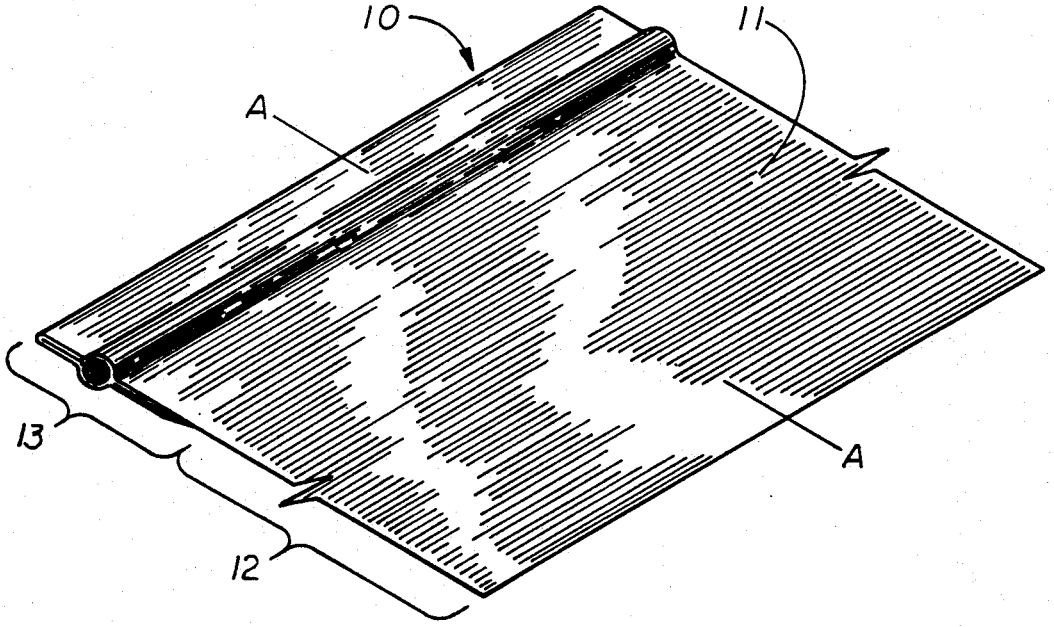
FIG. 2 is a planar perspective view of a length of the combination sill sealer and flashing of the present invention.

The combined sill sealer and flashing 10 of the present invention alleviates this problem and is illustrated in FIG. 2. The device 10 comprises a sheet 11 of flexible material that has the properties of being vapor permeable but impermeable to liquids; the perm rating is preferably less than 1.0. This fabric is also preferably tear resistant. The device 10 actually comprise two portions of the sheet 11 which itself is of sufficient dimension to allow for construction and use in the desired environment. The two portions are the sill sealer 13 and the flashing 12. FIG. 2 illustrates a portion of the device 10 since it is intended to be made in long lengths that are folded or rolled into packages for delivery to the job site where it is then easily cut to the desired lengths for the particular job.

Figure 3:
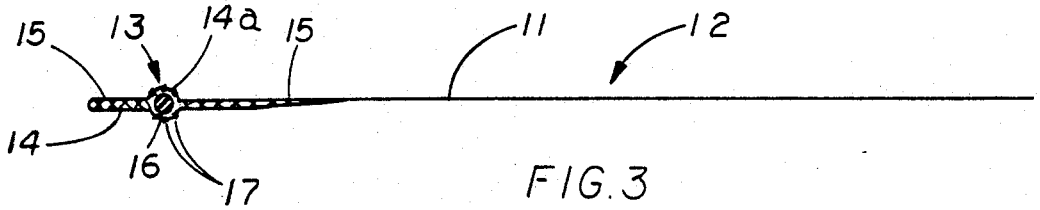
FIG. 3 is a cross section of a first embodiment of the combined sill sealer and flashing of the present invention taken along line A—A of FIG. 2.

FIG. 3 illustrates the embodiment of FIG. 2 in cross section along line A—A and comprises the sheet 11 with one end folded over forming a loop 14 in which is located a sealer means 16. This portion of the device 10 is the sill sealer 13. The folded over portion is bonded to the rest of sheet 11 on either side of the sealer means 16 at 15 by any suitable means such as glue, adhesive, heat bonding, RF bonding or the like leaving a channel 14*a* in which the sealer means 16 is located and within which it may be compressed. The channel has sufficient width to receive the sealer means 16 and allow for its spreading when compressed. The remaining portion of the sheet 11 forms the flashing 12.

Figure 3A:
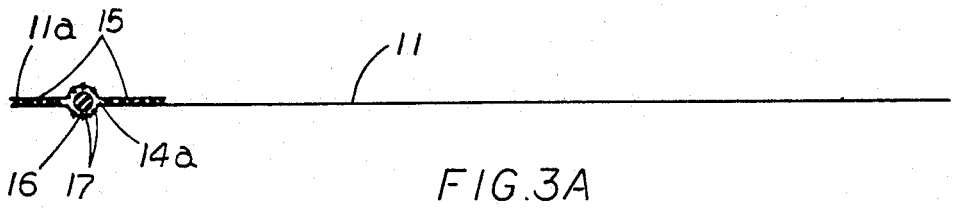
FIG. 3*a* is a cross section of an alternative construction of the combined sill sealer and flashing of the present invention.

In an alternative construction the sill sealer 13 may be formed from two separate pieces of sheet material 11 and 11*a* as shown in FIG. 3*a*. In this construction one or more strips of compressible sealer means 16 are laid along sheet 11 within a area of from three to nine inches from one of the long edges of sheet 11 and a second piece of sheet material 11*a* is placed over this area and bonded to sheet 11 on either side of sealer means 16 at 15. As with the loop construction the sheet material 11 and 11*a* is not bonded to the sealer means 16, rather channels 14*a* are left within which sealer means 16 may be compressed.

Sealer means 16 is a strip of compressible material having a length contiguous with that of the sheet 11. The compressible material may be a resilient, polymeric foam, such as a rope or strip of reasonable thickness, having the capability of being compressed but resuming its normal size and shape upon release of any compressing forces. Alternatively, it may be a flexible, malleable and/or resilient sealant, such as a curable silicon or other synthetic rubber or the like, which will deform and flow under pressure to fill voids and form a gasket-like seal between two surfaces. This type of sealant also preferably remains flexible when cured and is also capable of resuming its original size and shape upon release of compressive forces.

Preferably, and particularly in the case where the sealant material is employed, the area of the sheet 11, and when present 11*a*, forming channels 14*a* about the sealer 16 has perforated or weakened areas 17 that rupture under pressure to allow passage and spreading of the sealer 16, whether sealant or foam, to fill any voids occurring between the surfaces being sealed. At least one length of sealer 16 will be used in sill sealer 13 but for increased sealing multiple parallel lengths of foam or sealant material are preferable. It is even possible to use a combination of foam and sealant as long as the two materials are compatible.

Figure 4:
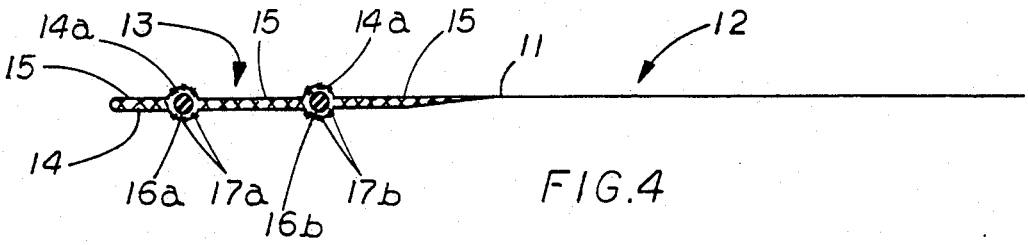
FIG. 4 is a cross section of a second embodiment of the present invention.

The second embodiment, shown in similar cross section in FIG. 4, illustrates such a construction with two strips of sealer 16*a* and 16*b* within the loop 14. Strips 16*a* and 16*b* may be the same or different material and each channel 14*a* is provided with appropriate perforations or areas of weakness 17*a* and 17*b*. As with the first embodiment, sheet material 11 will be bonded on either side of the multiple strips 16*a* and 16*b* as shown at 15 resulting in two channels 14*a* for the sill sealer. Similarly, the embodiment of FIG. 3*a* may have more than one strip of sealer 16 with second sheet 11*a* bonded to sheet 11 in the same manner. Although embodiments having only one or two strips of sealer 16 are illustrated, it is within the scope of this invention that more than two strips of sealer 16 could be employed depending on the conditions and the design of the structure being built.

Sill sealer 13 portion containing the sealer 16 is preferably the width of the bottom plate of a standard stud wall but should be at least three inches wide to provide sufficient space within the two plies of the sheet for the compressible material to flow into when it is compressed. Other widths may be necessary for different types of construction and are considered to be within the scope of this invention. Generally, however, a sill sealer 13 width of between three and nine inches should be sufficient. The sealer 16 should be pliant within a fairly extensive temperature range, at least from +20 to +100 degrees fahrenheit, preferably from 0 degrees to +150 degrees, and have a long shelf life. Also the thickness of the foam or other sealant is preferably at least 3/8 inch. Maximum thickness is variable and may depend on individual conditions.

The rest of the width of sheet 11 comprises a single thickness of the material and forms the flashing portion 12. Since the device 10 may be made available in different widths, the area of flashing 12 will be variable but it should be at least from four to forty eight inches from the sill sealer 13 to the edge of the flashing to accommodate most frame construction methods. Greater widths may be necessary for specialized constructions or uses such as the cantilever illustrated in FIG. 5 and are considered to be within the scope of this invention. Narrower widths will find utility in constructions such as those depicted in FIGS. 8 and 9 where a second piece of sill sealer and flashing 10*a* is installed between top plate 24 and foundation 7.

Figure 6:
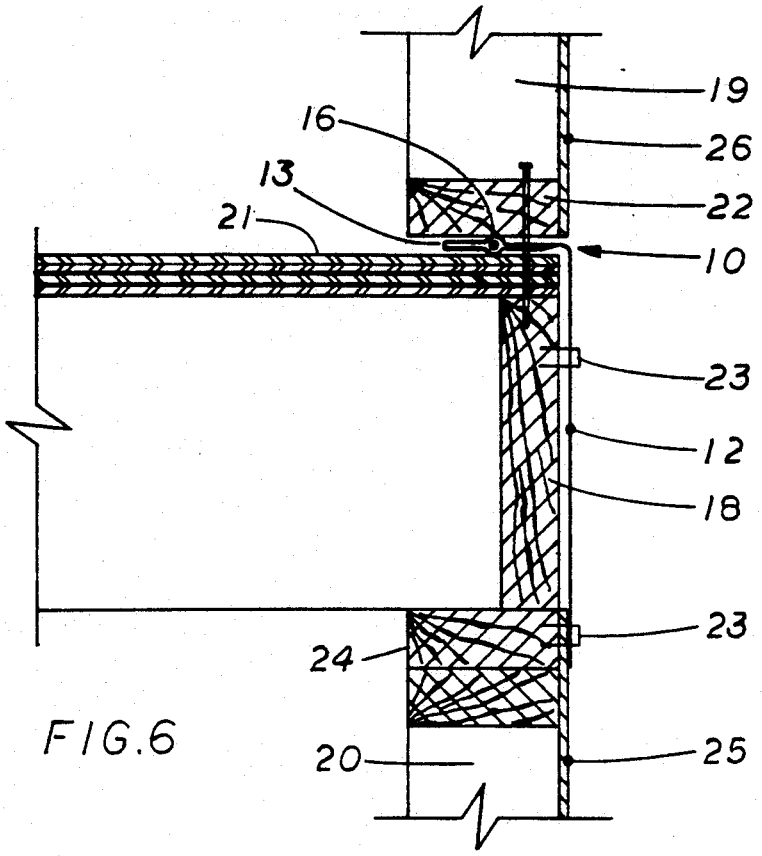
FIG. 6 is a vertical cross section of a flush face second floor construction employing the combined sill sealer and flashing of the present invention.
Figure 7:
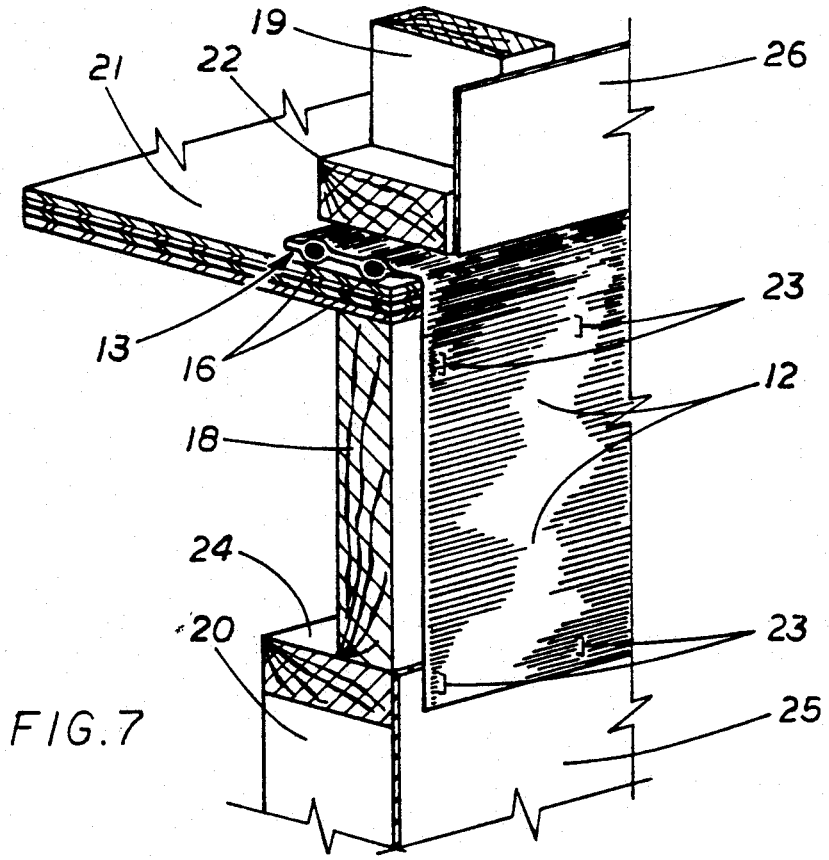
FIG. 7 is a partial front angle view of the construction of FIG. 6.

The sill sealer 13 provides a seal between the stud wall and the floor that expands as the wood framing members dry out and contract over time thereby maintaining a sealed and insulated construction. In addition, the sheet 11 overall and the flashing 12 in particular allow the structure to breath by being vapor permeable, but keeps condensation and liquid water away from the studs, joists and under sheathing. FIGS. 6 and 7 illustrate a standard frame construction employing the present invention between the framing 18 of a second floor and the second floor stud walls 19. The stud walls of the first floor 20 are below the framing 18.

In this construction, the combination sill sealer and flashing 10 has been installed with the sill sealer 13 between the second floor sub floor 21 and the wall plate 22 of the stud wall 19. Upon nailing of the stud wall 19 to the floor framing 18, the sealer 16 is compressed and provides an insulated seal between the structures. Flashing 12 folds downward over the edge of the subfloor 21 and covers the framing 18 to which it is loosely attached by staples 23 or the like. The extreme edge of flashing 12 preferably laps over the top plate 24 of the floor framing 18 and is stapled thereto. The lower floor sheathing 25 may extend upward a short distance beneath the edge of flashing 12 but should extend no further than top plate 24. Similarly, second floor sheathing 26 may extend downward to overlap the edge of subfloor 21 but is not attached thereto. Preferably, second floor sheathing 26 extends no lower than the bottom of second floor stud wall plate 22. With the combined sill sealer and flashing 10 in place it is not necessary to apply sheathing over the subfloor 21 edge and the framing 18 since the combination of the lumber and the materials of the sill sealer and flashing 10 provide sufficient insulation and liquid protection. Furthermore, since the sheathing does not extend over nor is attached to the framing 18 it will not buckle and bow outward as the lumber dries and the structure settles. Instead, flashing 12, because of its flexibility, will fold and wrinkle to accommodate the reduction in distance between wall plate 22 and top plate 24 and will not exert any pressure on any siding that is applied to the exterior of the structure.

Figure 5:
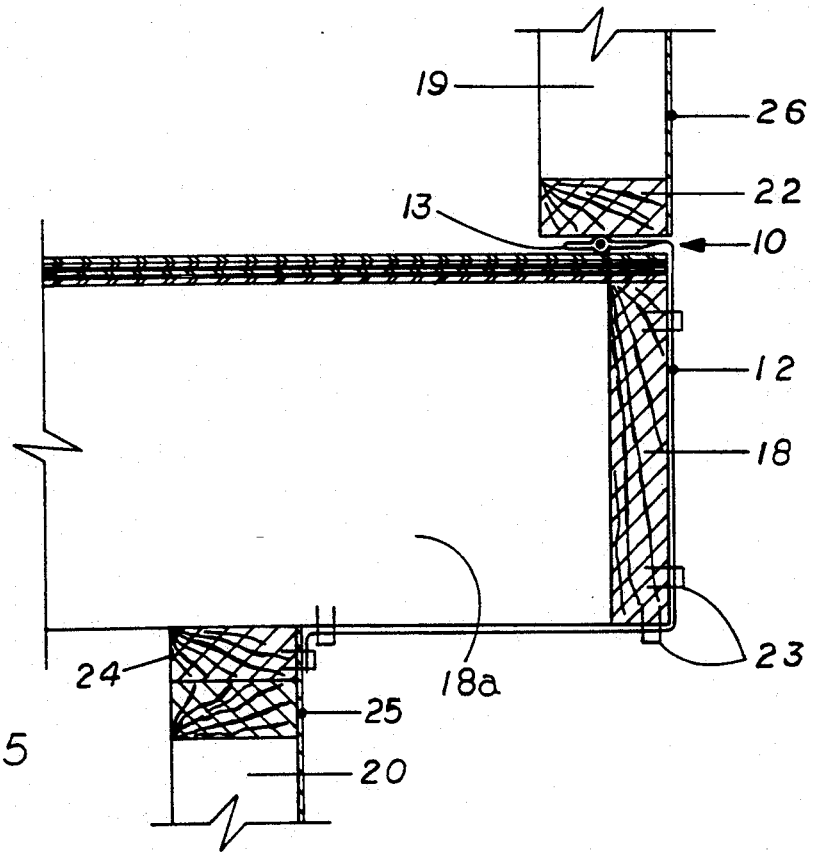
FIG. 5 is a vertical cross section of a cantilever construction employing the combined sill sealer and flashing of the present invention.

FIG. 5 illustrates the invention in use on a cantilever structure. In this construction, the second floor framing 18 rests on but extends out from the lower floor stud wall 20. As with the standard construction discussed above, The device 10 is installed with sill sealer 13 between the sub floor 21 and the second floor wall plate 22. Flashing 12 folds downward over the edge of the sub floor 21 and the floor framing 18. In this construction, however, flashing 12 is of sufficient width to extend underneath the cantilevered portion 18*a* of framing 18 and is attached by staples 23 to top plate 24. In this manner the cantilever structure 18*a* is fully covered by flashing 12 including the corner between the underside of the cantilever 18*a* and top plate 24. As before, lower floor sheathing 25 extends only to the underside of the cantilever 18*a* and upper floor sheathing 26 extends downward only to the bottom edge of wall plate 22. Insulation and sealing of the cantilever 18*a* is provided by the combined sill sealer and flashing 10 of the present invention. Furthermore, because of the liquid impermeability of sheet 11, any condensation or water leakage will be directed from the upper floor downward and around the cantilever 18*a* by flashing 12 rather than seeping into the framing 18.

The liquid impermeability of sheet 11 also serves to channel condensation and liquid from behind brick facing walls and siding as shown by the constructions depicted in FIGS. 8 and 9. In FIG. 8 a brick facing 27 has ben erected in front of the frame construction. The combined sill sealer and flashing 10 has been installed between the sub floor 21 and the stud wall 19 as described above with the flashing 12 extending downward over the outside of the framing 18. In addition a second piece of sill sealer and flashing 10*a* has been installed between the sill plate 24 and foundation 7. Since this is a first floor construction, the flashing 12*a* of the second piece 10*a* is shorter than the flashing 12 extending from the sub floor 21 and covers a portion of the foundation 7 beneath the first flashing 12. Brick facing 27 is constructed with weep holes 28 extending from inside to outside between lower courses of bricks. Flashing 12 is long enough to extend from the sub floor 21 into the weep holes 28 and acts as a conduit for any liquid leakage or condensation that drips down between the stud walls 19 and the brick facing 27. This extension of flashing 12 into the weep holes 28 also serves to keep such liquid and condensation away from the foundation 7.

In a similar fashion, as shown in FIG. 9, siding 29 may be provided with weep holes 30 along its lower edge to allow condensation and liquid to drain out from between it and the construction behind. As with the brick facing wall 27 of FIG. 8, flashing 12 extending downward from sub floor 21 is sufficiently long to channel liquid into the siding weep holes 30. Also as in he embodiment of FIG. 8, a second piece of sill sealer and flashing 10*a* is installed between the top plate 24 and foundation 7 with its flashing 12*a* extending over the foundation 7 beneath the flashing 12 of the sill sealer and flashing 10 installed between sub floor 21 and stud wall 19. In this manner condensation forming or liquid collecting between the siding 29 and the frame construction will be channelled directly to the siding weep holes 30.

The accompanying figures illustrate the combined sill sealer and flashing 10 of the invention in use in the standard types of construction employed in the housing industry. However, it is to be noted that these are for example only and it is within the scope of this invention that the device could be used in any type of construction where the underlying problems associated with settling and condensation formation or leakage might occur. Furthermore, the foregoing examples have been directed to the application of only a single sheet of the sill sealer and flashing 10 at any one location. This will usually be sufficient. However, it is considered within the scope of this invention to provide multiple thicknesses where extra insulation is required. In cases where multiple thicknesses of sheet material 11 are desired it may be obtained by using two or more layers of the complete sill sealer and flashing structure 10 placed over each other which has the added advantage of providing a plurality of sealing strips between the sub floor 21 and wall plate 22. Alternatively, the flashing may be fashioned from a sheet material 11 that is quilted or has an added flexible insulating sheet on one or both sides.

The combined sill sealer and flashing 10 may be manufactured as a pre-constructed element for ease of use and is intended to be provided in rolls or coils of long lengths which may be unrolled and cut to the required length. Alternatively, it may be constructed on site from a kit comprising a roll of the sheet material 11 and the separate sealer 16, whether a roll of foam sealer or cartridges of extrudable sealant, with the folded over edge of the flashing sheet being secured in place by staples or nails. As long as the requirements of vapor permeability, water impermeability, easy sheet flexibility and resilient sealer compressibility are adhered to, various materials may be used in the formation of the herein disclosed combination sill sealer and flashing.

Although the foregoing description sets forth the best and preferred mode of practicing the present invention, other modifications and methods that may become obvious therefrom to one of skill in the art are considered to be within the scope of the disclosure and the following claims.

What is claimed is:

1. A combination sill sealer and flashing for use in frame building construction wherein a stud wall is constructed upon a sub-floor, said combination sill sealer and flashing comprising:

a) a sheet of flexible material which is vapor permeable, liquid impermeable and has a perm rating of less than 1.0, b) at least one length of compressible sealant material, wherein said sheet of flexible material comprises a first portion forming an elongated sill sealer along one edge thereof and a second portion forming a flexible flashing; said first potion comprising a channel formed by two layers of said sheet and confining said sealant material, said two layers being bonded to each other along their respective lengths on both sides of said sealant material, and said second portion comprising at least one of said two layers extending laterally beyond said first portion;

whereby, said first portion is positionable between said stud wall and said sub-floor and said second portion is extendable outward from between said stud wall and said sub-floor to wrap downward over an outer surface of said frame construction.

2. The combination sill sealer and flashing of claim 1 wherein said two layers of said sheet are formed by folding a portion of said sheet over said sealant to form an elongated loop within which said sealant material is located and is longitudinally contiguous therewith.

3. The combination sill sealer and flashing of claim 1 wherein said two layers of said sheet are separate pieces, the first layer being of sufficient width to provide said flashing and the second layer being of narrower width to cover said sealant material and form a sill sealer having a width of from three to nine inches.

4. The combination sill sealer and flashing of claim 1 having at least two parallel lengths of sealant.

5. The combination sill sealer and flashing of claim 4 wherein said at least two lengths of sealant are spaced apart along their lengths and said two layers of said sheet are bonded therebetween.

6. The combination sill sealer and flashing of claim 1 wherein said sheet is provided with perforable areas in said at least one channel adjacent said sealant.

7. The combination sill sealer and flashing of claim 1 wherein said length of sealant is a rope of resilient polymeric foam.

8. The combination sill sealer and flashing of claim 1 wherein said length of sealant is a flexible, malleable, resilient sealant material.

9. The combination sill sealer and flashing of claim 8 wherein said sealant is a curable synthetic rubber.

10. The combination sill sealer and flashing of claim 1 wherein said sealant is a pliable, compressible, resilient material having a long shelf life and capable of retaining its pliancy at temperatures from 0° to +150° F.

11. A combination sill sealer and flashing comprising:

a sheet of flexible material having vapor permeability and liquid impermeability, and at least one length of pliable, compressible, resilient sealant material;

wherein said sheet is a running length of said material having a width of from ten to sixty six inches, one running length edge of which is folded over and bonded to said sheet across an area having a width of from three to nine inches, at least one longitudinal channel therealong being left unbonded, and said sealant material is disposed within said channel in a manner to be longitudinally contiguous therewith, and the remainder of said sheet extends laterally beyond said channel and forms an area of flashing; whereby said channel and said sealant material form a sill sealer which is placed between a sub-floor and a stud wall of a frame construction and said flashing extends outward over said frame construction.

12. The combination sill sealer and flashing of claim 11 wherein said sealant is selected from the group consisting of polymeric foam, curable silicon and synthetic rubber, said sealant having a thickness of at least 3/8 inch.

13. The combination sill sealer and flashing of claim 12 wherein said sealant is a preformed running length inserted into said channel.

14. The combination sill sealer and flashing of claim 12 wherein said sealant is extruded onto said sheet and said channel is formed over said length of sealant.

* * * * *